United States Patent [19]

Schriber

[11] 4,006,422

[45] Feb. 1, 1977

[54] DOUBLE PASS LINEAR ACCELERATOR OPERATING IN A STANDING WAVE MODE

[75] Inventor: Stanley O. Schriber, Deep River, Canada

[73] Assignee: Atomic Energy of Canada Limited, Ottawa, Canada

[22] Filed: Mar. 3, 1975

[21] Appl. No.: 554,562

[30] Foreign Application Priority Data

Aug. 1, 1974 Canada ..... 206107

[52] U.S. Cl. ..... 328/233; 315/5.41

[51] Int. Cl.² ..... H01J 23/20; H05H 9/04

[58] Field of Search ..... 328/233; 315/5.41, 5.42

[56] References Cited

UNITED STATES PATENTS

| | | | |
|---|---|---|---|
| 3,239,711 | 3/1966 | Norris | 315/5.41 X |
| 3,349,335 | 10/1967 | Crowley-Milling | 328/233 |
| 3,403,346 | 9/1968 | Giordano | 328/233 |
| 3,546,524 | 12/1970 | Stark | 328/233 X |
| 3,611,166 | 10/1971 | Epsztein et al. | 328/233 |

*Primary Examiner*—Palmer C. Demeo
*Attorney, Agent, or Firm*—Edward Rymek

[57] ABSTRACT

A double pass linear accelerator which is used in a radiation therapy unit to provide electron radiation or photon bremsstrahlung radiation when combined with an appropriate target. The accelerator operates in a standing wave mode and includes an accelerating section, a charged particle source and injection section, a microwave source operating in the S band and adapted to excite the accelerating section and a reflector system which is mounted at one end of the accelerating section to reflect a particle beam which has been accelerated due to one pass, back into the accelerating section such that it may be further accelerated. The distance between the reflector is made adjustable to provide for output particle energy variation.

6 Claims, 6 Drawing Figures

DOUBLE PASS LINEAR ACCELERATOR OPERATING IN A STANDING WAVE MODE

Figure 1:
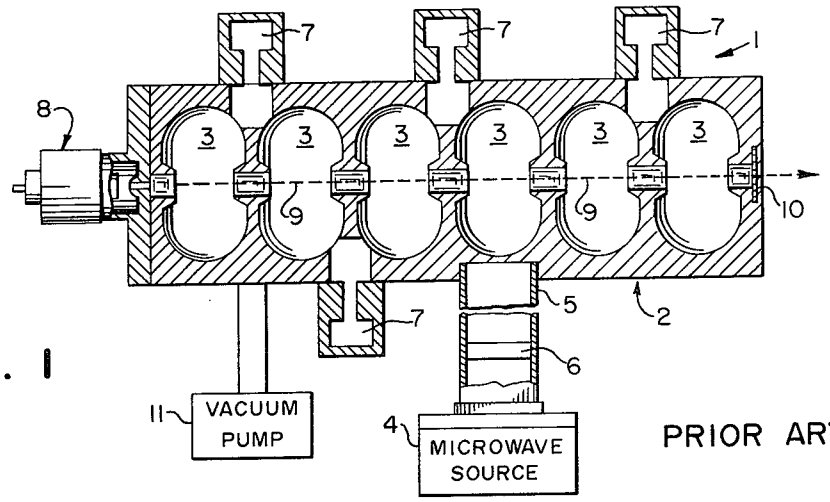
FIG. 1 PRIOR ART

This invention relates to linear accelerators and in particular to linear accelerators in which the beam of particles is passed through the accelerating section in one direction, turned around and passed through the accelerating section in the other direction.

In recent years, electron accelerators have been supplanting conventional $^{60}$Co units for cancer therapy with increasing frequency since the photon bremsstrahlung radiation is more penetrating; electron beam radiation treatment is also possible; the radiation intensity and field can be higher, more defined and does not decay, and there is relatively little or no radiation hazard when the machine is off.

Linear accelerators are most commonly used to accelerate the particles such as electrons, however in the medical field it is preferred to have a compact system which will fit into a therapy frame somewhat similar to a conventional rotating $^{60}$Co system. To achieve high energy gains in a relatively small accelerating section, linear accelerators have been developed in which the beam is repeatedly passed through the accelerating section in one direction.

One such system is described in U.S. Pat. No. 3,349,335 entitled "Electron Accelerator Means with Means for Repeatedly Passing the Initial Electron through the Accelerator" which issued to M. C. Crowley — Milling on Oct. 24, 1967. This accelerator provides a multiple energy gain to the particles, however the beam follows a path which is relatively broad compared to the size of the accelerating sections.

It is therefore an object of this invention to provide an accelerator which is compact.

A further object of this invention is to provide an accelerator having a high energy output and high shunt impedance.

Yet another object of this invention is to provide an accelerator in which energy variations are possible without varying the rf drive system.

A further object of this invention is to provide an accelerator which is simple and economical to construct.

These and other objects are generally achieved in an accelerator operating in the standing wave mode which has a series of resonant cells formed into a single accelerating structure. The structure is driven by an rf source. An injection system that is off-axis and uses magnetic or electric deflection can be used to inject a beam into one end of the accelerating structure, or a source can be mounted on the accelerator axis by making it of annular disk geometry. A reflecting magnet system which is achromatic, isochronous and non-magnifying is mounted at the other end of the accelerating structure such that the distance between the reflector and the accelerating structure may be varied. The beam of particles is accelerated during the first pass through the accelerating structure, turned around and accelerated to some degree during the second pass depending on the relative phase of the particle bunch to the rf fields in the second pass. The energy in the emerging beam may be altered by moving the reflector relative to the accelerating structure, by altering the magnetic fields in the reflector or both.

In drawings:

FIG. 1 illustrates a typical side-coupled prior art linear accelerator operated in the $\pi/2$ mode.

Figure 3:
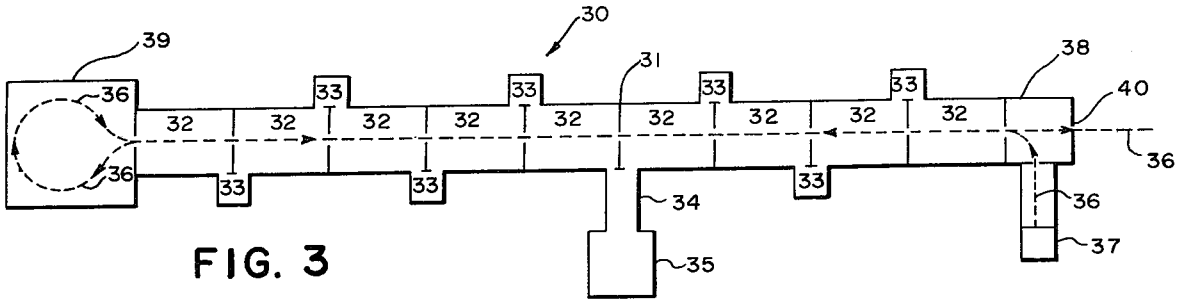
Figure 2A:
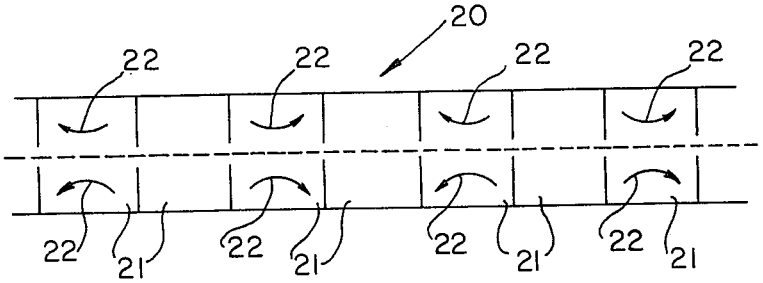
Figure 2B:
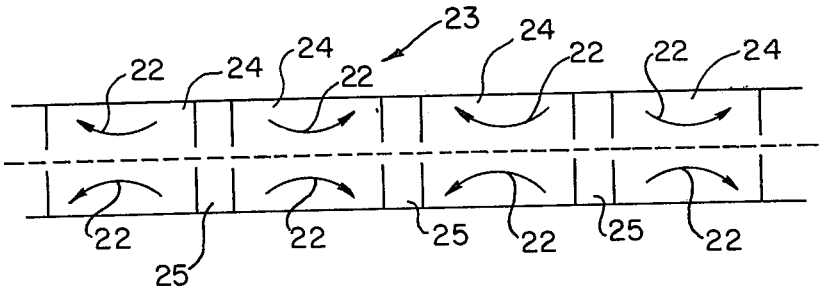
Figure 2C:
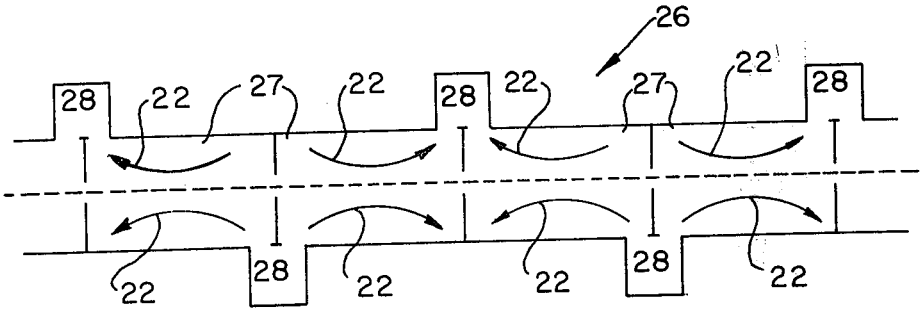
Figure 4:
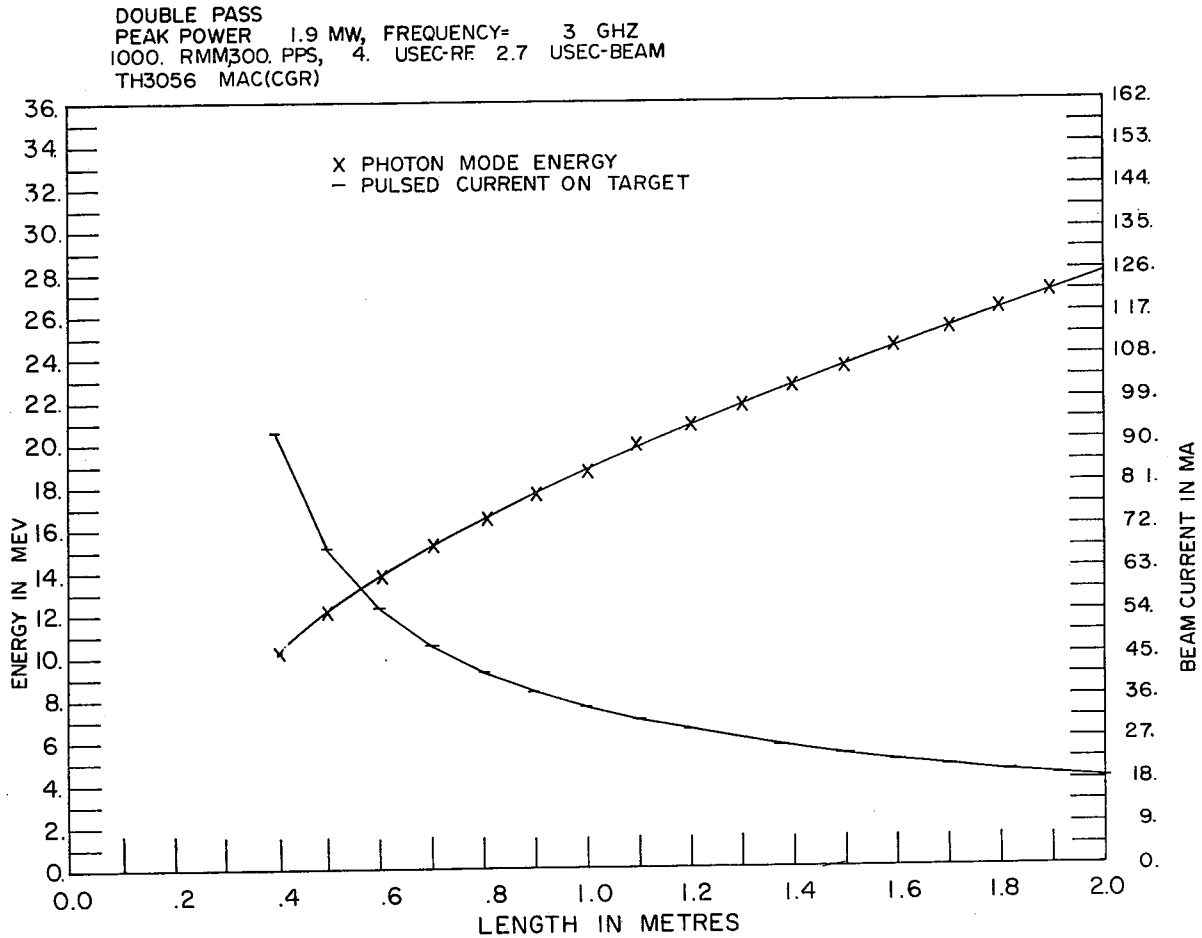

FIG. 2 schematically illustrates the fields in an accelerating structure having (*a*) a biperiodic resonant cavity chain, (*b*) on-axis coupling and (*c*) side coupling, FIG. 3 schematically illustrates the linear accelerator in accordance with this invention, FIG. 4 is a graph showing characteristics for a double pass accelerator system in accordance with this invention.

FIG. 1 illustrates a typical linear accelerator 1 which includes an accelerating section 2 made up of a number of accelerating cavities 3. The accelerating section 2 is excited by a microwave source 4, such as a klystron amplifier or magnetron, connected to section 2 by a waveguide 5 with a microwave window 6. A standing wave is established through the accelerating section 2 by the coupling cavities 7. A source of charged particles 8 generates and injects a beam 9 of particles such as electrons into one end of the accelerating section 2 along its axis. These particles are bunched and accelerated by the standing wave fields as they move through the accelerating section 2 and exit the accelerator via window 10. The beam may then be directed to a target so as to provide bremsstrahlung radiation or miss the target completely for electron beam radiation therapy. A vacuum pump 11, shown in FIG. 1, is used to evacuate the particle source 8 and accelerating section 2.

Though side-coupling is shown, other forms of energy coupling, such as coupling cavities pancaked between resonant cavities 3, may be used.

In the publication "Standing Wave High Energy Linear Structures" by E. A. Knapp et al. The Review of Scientific Instruments, Vol. 39, Number 7, July 1968, various standing wave structures and the unique properties of the $\pi/2$ mode of operation in resonant accelerator applications are discussed. Since the eigenfunctions in the $\pi/2$ mode are $$X_n^{(\pi/2)} = \cos(n\pi/2)e^{j\omega_o t} \quad (1)$$

where $X_n$ is amplitude, the even cavities have an amplitude of $\pm 1$, the odd cavities have an amplitude of 0, and there is a $\pi$ phase shift between adjacent even cavities. This is shown in the accelerating section 20 in FIG. 2 (*a*) wherein the direction of the field in the cavities 21 are represented by arrows 22. The above accelerating section 20 would not be very efficient as an accelerator since half of the accelerating section provides no energy transfer to the beam of particles. However it has been found that as long as all of the cavities are tuned to the same uncoupled resonant frequency, the cavity geometry may be changed. This is shown in FIG. 2 (*b*) wherein the accelerating section 23 includes even (accelerating) cavities 24 and odd (coupling) cavities 25 with arrows 22 representing the direction of the field.

A further configuration which is shown in FIG. 2 (*c*) is the side-coupled accelerating section described with respect to FIG. 1. In this configuration of the accelerating section 26, the accelerating cavities 27 are adjacent one another with the coupling cavities 28 positioned completely off of the beam path, but coupled into the accelerating cavities. Arrows 22 again indicating the field direction. This configuration optimizes the efficiency of the linear accelerator which is indicated by the effective shunt impedance, defined as:

$$ZT^2 = \frac{(\text{Peak particle energy gain/unit length})^2}{(\text{power dissipated to the structure/unit length})} \quad (2)$$

Referring now to FIG. 3, the linear accelerator of this invention will be described in which up to twice the output energy can be obtained for the same rf power dissipation by the single pass accelerators described above. As can be seen from the shunt impedance equation (2), it is equivalent to increasing the effective shunt impedance by a factor of four. Though the preferred embodiment is described in terms of $\pi/2$ mode excitation, other standing wave modes may be used such as $2\pi/3, \pi/3$, etc.

The accelerator 30 shown in FIG. 3 consists of an accelerating section 31 having a series of accelerating cavities 32 side coupled by coupling cavities 33. A standing wave field in the $\pi/2$ mode is excited in the accelerating section 31 by a microwave source 35 by means of a waveguide 34, such that even numbered cavities 32 have an amplitude $\pm 1$ and odd numbered coupling cavities 33 have an amplitude 0. A beam of particles 36 such as electrons, is generated by source 37 and injected into one end of the accelerating section 31 by means of a magnetic or electric deflector 38. Finally a turnaround or reflector 30 mounted at the other end of the accelerating section 31 is used to reflect the beam 36 upon itself such that it returns through the accelerating section and exits through an exit window 40.

The accelerating section 31 may be of the sidecoupled type as shown in FIG. 3, however it has been found that an accelerator structure using pancake couplers, following the configuration of FIG. 2 (*b*), although having an effective shunt impedance slightly lower than an equivalent side coupled system, is easier to tune, fabricate and mount into a small space. In addition, although accelerating cavities of equal length are shown in FIG. 3, it has been determined that it is preferred to have individual cell lengths which are of increased length from the end into which the particles are first injected. The width of the first cells are adjusted upward quite rapidly, while the remainder are relatively constant in width. Table 1 below illustrates one example of such an accelerating section at S-band frequency having 31 accelerating cells with an input energy of 41.5 keV. The output energies are those calculated for the phase stable particles.

TABLE 1

| Input Energy<br>Frequency | | 41.5 keV<br>3000 MHz |
|---|---|---|
| INDIVIDUAL CELL PARAMETERS | | |
| CELL | ENERGY OUT (MeV) | Length (M) |
| 1 | .282 | .0286 |
| 2 | .612 | .0413 |
| 3 | .969 | .0457 |
| 4 | 1.336 | .0475 |
| 5 | 1.708 | .0483 |
| 6 | 2.084 | .0488 |
| 7 | 2.461 | .0491 |
| 8 | 2.839 | .0493 |
| 9 | 3.218 | .0494 |
| 10 | 3.597 | .0495 |
| 11 | 3.977 | .0496 |
| 12 | 4.357 | .0497 |
| 13 | 4.738 | .0497 |
| 14 | 5.119 | .0497 |
| 15 | 5.499 | .0498 |
| 16 | 5.880 | .0498 |
| 17 | 6.262 | .0498 |
| 18 | 6.643 | .0498 |

TABLE 1-continued

| Input Energy<br>Frequency | | 41.5 keV<br>3000 MHz |
|---|---|---|
| INDIVIDUAL CELL PARAMETERS | | |
| CELL | ENERGY OUT (MeV) | Length (M) |
| 19 | 7.024 | .0498 |
| 20 | 7.405 | .0499 |
| 21 | 7.787 | .0499 |
| 22 | 8.168 | .0499 |
| 23 | 8.550 | .0499 |
| 24 | 8.931 | .0499 |
| 25 | 9.313 | .0499 |
| 26 | 9.695 | .0499 |
| 27 | 10.076 | .0499 |
| 28 | 10.458 | .0499 |
| 29 | 10.840 | .0499 |
| 30 | 11.221 | .0499 |
| 31 | 11.603 | .0499 |

The excitation source may be a magnetron or klystron operating at S band for example. It may preferably operate in a pulsed mode because of low mean current applications when the accelerator is used in radiation therapy.

The particle source 37 may be of any known type and is shown mounted below the accelerator axis for mechanical and beam handling reasons. The magnetic or electric deflection system 40 may deflect the beam 90° as shown or at any other necessary angle depending on the angle at which the source 37 is mounted. However deflector 40 may be eliminated from the accelerator if a source which has an annular disk geometry is mounted on the accelerator axis.

Finally, the turn-around or reflector 39 must be achromatic, isochronous and non-magnifying such that all particles in the beam are reflected back into the accelerating section along their original path whether they vary in energy, path or angle of entry into the reflector. One such reflector system is described in a co-pending application Ser. No. 554,563 entitled Achromatic Isochronous Magnetic Particle Reflector filed on Mar. 3, 1975 and issued to U.S. Pat. No. 3,967,225 on June 29, 1976, in the name of E. A. Heighway, assignor to Atomic Energy of Canada Limited, the common assignee with the instant application. In addition, the reflector 39 may be mounted on a moveable carriage such that the distance between the reflector 39 and the accelerating section 31 may be adjusted along the accelertor axis. The vacuum in the system may be maintained by providing a bellows between the reflector 39 and the accelerating section 31. This allows the beam energy to be altered by changing the phase of entry of the beam to the accelerating section 31 for its second pass. The beam energy may also be altered by altering the magnetic field in the reflector 39.

This accelerator described above finds particular use as a radiation source in the medical field. The accelerated beam 36 may be used directly for electron radiation therapy or it may be directed at a target (not shown) for photon bremsstrahlung radiation. FIG. 4 shows the characteristics of the double pass accelerator system in which a magnetron provides the excitation with pulsed power of 1.9 MW with pulse width of 4 $\mu$ sec at 300 pps, with a frequency of 3GHz, and for 1000 RMM optimum thickness target spectrum over a 40 cm. diameter circle at 100 cm. The output energy in MeV and the beam current in mA are given as a function of the accelerator length in meters. The region to the left of the graph is the area not recommended for operation since in the electron mode, accelerating gradients in excess of 18 MeV/m will be encountered. An accelerator of length greater than 140 cm is required to have an energy in excess of 22 MeV.

Typical magnet positions for different output energies in the photon mode and electron mode for the above 31 cell system in accordance with this invention are given in Table 2. The different photon energy outputs are obtained by operating at different magnet-accelerator distances and at different gradients associated with beam loading differences.

TABLE 2

| Mode | Output Energy (MeV) | Magnet Position to a Reference Position (cm.) |
|---|---|---|
| Photon | 21 | 0.63 |
| Photon | 16 | 1.03 |
| Photon | 8 | 1.75 |
| Electron | 25 | 0.63 |
| Electron | 20 | 1.25 |
| Electron | 16 | 1.55 |
| Electron | 12 | 1.78 |
| Electron | 8 | 2.00 |
| Electron | 5 | 2.22 |

I claim:

1. A linear accelerator system comprising:

a. an accelerating section having a series of accelerating cavities coupled by coupling cavities; each of said cavities being tuned to a predetermined frequency;

b. a microwave souce means coupled to said accelerating section for exciting a standing wave field in said accelerating section;

c. a charged particle source means for injecting a beam of charged particles into one end of said accelerating section, to be accelerated along a beam path; and d. a reflector means, mounted at the other end of said accelerating section, for receiving said charged particles from said accelerating section, altering the beam direction by 180° and reinjecting the beam into said accelerating section along said beam path to further accelerate said charged particles.

2. A linear accelerator system as claimed in claim 1 wherein said reflector means is a magnetic field system which is achromatic and isochronous.

3. A linear accelerator system as claimed in claim 1 wherein said accelerating cavities are mounted adjacent one another with said coupling cavities mounted on the side of said accelerating cavities.

4. A linear accelerator system as claimed in claim 1 wherein each of said accelerating cavities and each of said coupling cavities are alternately mounted about a linear axis.

5. A linear accelerator system as claimed in claim 1 wherein said particle source means is mounted to one side of said accelerating section and includes means for directing said particle beam into said accelerating section along the accelerator axis.

6. A linear accelerator system as claimed in claim 1, wherein said standing wave field is in the $\pi/2$ mode.

* * * * *